United States Patent [19]

Blanche et al.

[11] 4,273,409

[45] Jun. 16, 1981

[54] CONNECTOR HAVING LOW PROFILE CONTACT ELEMENT

[75] Inventors: Stephen A. Blanche, Warwick; Lee Portrais, North Scituate, both of R.I.

[73] Assignee: Victor Electric Wire & Cable, West Warwick, R.I.

[21] Appl. No.: 72,163

[22] Filed: Sep. 4, 1979

[51] Int. Cl.[3] ..... H01R 4/18

[52] U.S. Cl. ..... 339/206 P; 339/191 R; 339/218 R; 339/258 R; 339/276 T

[58] Field of Search ..... 339/191, 192, 206 P, 339/258 R, 258 P, 276 T, 277, 218 R

[56] References Cited

U.S. PATENT DOCUMENTS

| | | | |
|---|---|---|---|
| 2,525,210 | 10/1950 | Del Camp | 339/192 T |
| 2,697,211 | 12/1954 | Voelkner et al. | 339/185 R |
| 3,274,533 | 9/1966 | Apted et al. | 339/192 R |
| 3,286,220 | 11/1966 | Marley et al. | 339/192 R |
| 3,553,628 | 1/1971 | Crimmins | 339/276 T |
| 4,059,888 | 11/1977 | Leh | 339/206 P |
| 4,082,402 | 4/1978 | Kinkaid et al. | 339/276 T |

*Primary Examiner*—John McQuade
*Attorney, Agent, or Firm*—Salter & Michaelson

[57] ABSTRACT

An electrical conductor of the molded plug type having a protective enclosure in which portions of a contact element are housed. The contact element in one embodiment of the invention includes a pair of spaced apart legs forming a split terminal portion adapted to receive a bayonet-type male contact element adapted to project through the open end of the enclosure. The legs are generally spaced from upper and lower enclosure walls except at the forward terminal ends thereof which contact the walls thus accomplishing a spring action along generally the full extent of the spaced leg portions. Another feature of the invention is the use of a low profile conductor tongue formed by the rear portions of the legs in face to face contact with each other such that the tongue may project through an opening provided in a rear wall of the enclosure. In this regard, a novel clamping assembly whereby a conductor may be attached to such low profile tongue is provided. Accordingly, one of the leg portions is provided with an opening or slot in which the terminal portions of a tongue encircling clamp may be secured while the conductor itself is secured between the inside of the clamp and the outside face of that leg portion distal from such slot.

5 Claims, 8 Drawing Figures

CONNECTOR HAVING LOW PROFILE CONTACT ELEMENT

BACKGROUND AND SUMMARY OF THE INVENTION

This invention relates to a connector and particularly an electrical connector of the molded plug type in which a plurality of spaced female contact elements are housed within the plug and in turn adapted to receive a plurality of bayonet-type male contact members. Generally plugs of this type are formed in situ by known molding procedures such that the female contact elements are in effect embedded in the material structure of the plug. In such structures, it is desirable to house the female contact element within a protective enclosure such that the plug material during molding is prevented from engaging the contact elements which would adversely affect their operation and electrical conductivity. Such enclosures may be of sleeve-type configuration, open at the front end, that is, the end proximal the contact face of the plug, and enclosed at the rear or inner end at the interior portions of the plug. A plug construction which utilized such protective enclosures and an associated molding method is described in U.S. Pat. No. 2,697,211 issued Dec. 14, 1954.

Another feature of molded plugs of this general type is that the enclosure includes an opening in the rear wall thereof through which a tongue-like portion of the contact element may project for connection to an electrical conductor also housed within the plug body by known contact attachment techniques. In this regard, it is advantageous that the conductor tongue be of a low profile, i.e. essentially flat and that it extend snugly through the opening in the rear enclosure wall so that plug material will not be forced into the enclosure through such opening during the molding procedures when the material which forms the plug is in an essentially fluid state and under considerable pressure. However, such low and essentially flat profile of the conductor tongue i.e., without any upstanding crimping fingers or wings, presents difficulty in achieving a suitable mechanical and electrical connection with the conductor wire to be attached thereto.

It is accordingly an object of the present invention to provide a contact element suitable for use in the above-described plug type construction and means which enables conductor wires to be easily and securely attached thereto so as to provide and adequate mechanical and electrical connection herewith.

A further object of the present invention is the provision of a contact element having a split terminal portion including a pair of spaced apart legs adapted for use in conjunction with a protective enclosure within an overall molded plug construction which imparts a unique spring-type grasping action upon male bayonet-type contact elements received thereby.

These and other objects of the present invention are accomplished by a contact element having a split terminal portion including a pair of spaced apart legs disposed within a separate enclosure having spaced upper and lower walls in part forming an open front end. These spaced legs terminate in an outwardly angularly flared end disposed in respective contact with said upper and lower enclosure walls proximal said open front end thereof. The remaining portions of the contact elements within the enclosure are generally spaced from the upper and lower walls whereby when a male bayonet-type element is forced between said legs, a stronger resilient gripping action is achieved then would be the case if the legs were not anchored at their forward ends. In addition, the enclosure is provided with a rear wall having an opening through which a generally flat rearwardly disposed tongue connector portion of the contact passes. The contact element may be formed of a one piece flat material strip reversely bent upon itself such that opposite rear leg portions thereof are in face to face disposition to each other so as to form said rearwardly disposed conductor tongue. One of the rear leg portions includes an opening or slot such that the terminal ends of a clamp extending about said tongue may be received in said slot. The conductor is in turn disposed between inner portions of the clamp and the outer face of the other rear leg portion so as to firmly secure such in place and so as to provide the necessary electrical and mechanical contact between the conductor and the contact element.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is an assembly view with parts broken away showing a plug construction in which the contact element assembly of the present invention is disposed and in turn adapted for electrical connection with a power inlet which may be mounted on the housing wall of an electrical appliance of the like;

FIG. 8 is a sectional view similar to FIG. 7 but showing the manner in which the split terminal legs of the contact element are expanded so as to resiliently receive a bayonet or blade-type contact element disposed within an appliance receptacle and the like.

DESCRIPTION OF THE INVENTION

Figure 1:
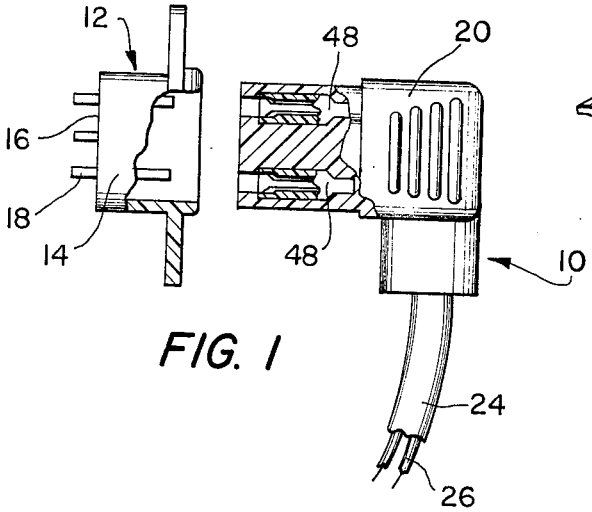
Figure 2:
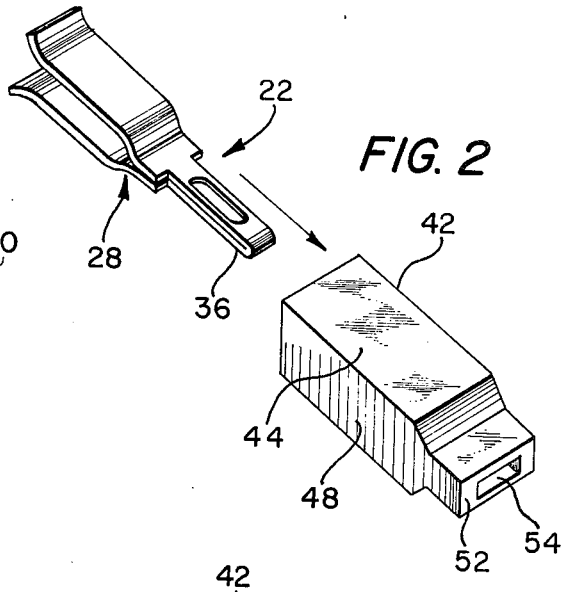
FIG. 2 is an exploded perspective view showing in particular the construction of the contact element and its protective enclosure.
Figure 3:
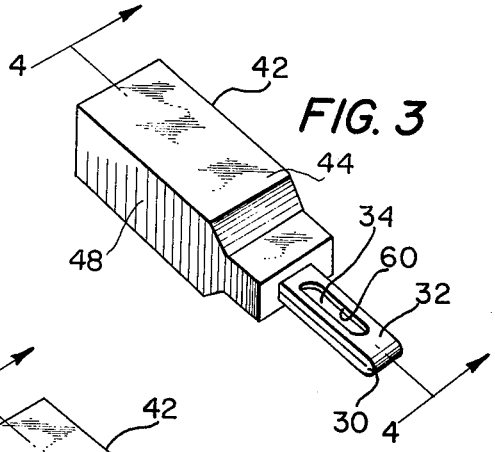
FIG. 3 is a perspective view similar to FIG. 2 but showing the contact element disposed within its enclosure with the conductor tongue portion thereof rearwardly extending therefrom.
Figure 4:
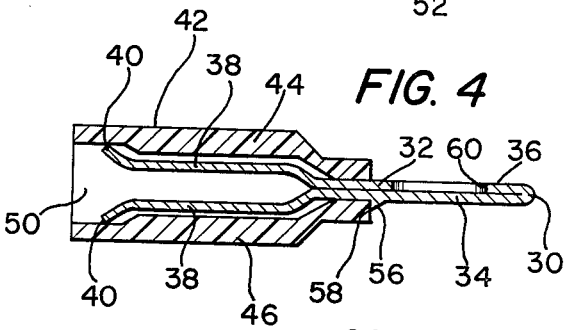
FIG. 4 is a sectional view taken along the line 4—4 of FIG. 3.

Turning to the drawing and particularly FIG. 1 thereof, a connector plug 10 is shown positioned for attachment with a power supply receptacle 12 as may be attached to the housing (not shown) of an electrical appliance and the like. Receptacle 12 includes a body 14 of generally cup-like configuration and having a rear wall 16 through which a plurality of blade or bayonet-type male contact elements 18 extend to opposite sides thereof. In this manner then, the receptacle 12 is adapted to receive the plug 10 and transmit power through or receive power from the receptacle.

The plug 10 is of the molded type and exhibits an enlarged body or head portion 20 formed from plastic, rubber or rubber-like material which preferably is molded in situ about a plurality of female contact element assemblies 22 constructed in accordance with the present invention. A power cord 24 having a plurality of individual conductors 26 is enclosed by the molded plug 20 at one terminal end thereof for connection with the contact element assemblies so as to provide electrical power thereto. Each assembly 22 includes an individual female contact element 28 formed from a single, generally flat metal material strip. The strip is bent centrally thereof so as to form a generally U-shaped bend 30 at the inner terminal end thereof and so as to dispose opposed body portions 32 and 34 in face to face contact with each other so as to cooperatively form a conductor tongue 36. Forward portions of the contact elements 22 include a pair of spaced apart generally parallel legs 38 which each in turn terminate in an outwardly flared end 40.

An enclosure 42 is provided for each element 28 and is formed of suitable plastic material. The enclosure 42 includes an upper wall 44, a lower wall 46 spaced therefrom and connecting sidewalls 48 which cooperatively form an open forward end 50. The rear of the enclosure 42 is provided with a rear wall 52 having a low profile, essentially slot-like configured opening 54 disposed therethrough. The opening 54 is adapted for receipt of the conductor tongue 36 and is dimensioned such that the tongue 36 essentially entirely fills the opening 54 such that the plastic or rubber-like material under pressure and in a fluid state during the molding of the plug 20 is prevented from entering interior portions of the enclosure 42 through the opening 54 and subsequently contacting interior surfaces of legs 38 so as to adversely affect electrical conductivity of the device. Similarly, the open forward end 50 of the enclosure 42 is provided with a mold element of known construction which prevents fluid plug material from entering the enclosure at said forward open end. A barb 56 having a trailing shoulder 58 in turn adapted for contact with the outer face of the end wall 52 serves to prevent the contact element 22 from becoming disassociated with the enclosure 42 once assembled therewith.

Figure 7:
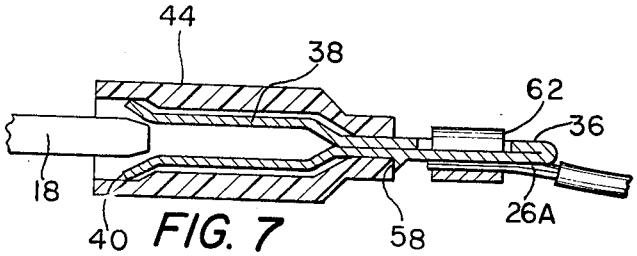
FIG. 7 is an elevational sectional view taken along the line 7—7 of FIG. 5.
Figure 8:
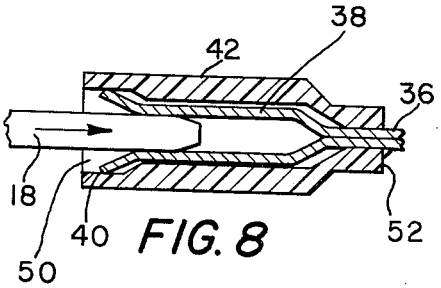

In addition, it should be pointed out that the ends 40 of the legs 38 are adapted to contact interior portions of the upper and lower walls 44 and 46 respectively. Also, the remaining portions of the legs 38 are adapted to be spaced apart from the inner surfaces of the upper and lower walls such that when one of the blade type contact elements 18 is inserted within the open end 50 of the enclosure for receipt between the split terminal legs 38 of the contact element 22, generally the entire extent of such legs 38 expands towards the respective inner surfaces of the upper and lower walls 44 and 46 rather than merely the ends 40 thereof being pivotally spread apart as is common in prior art constructions. Accordingly, an enhanced and more controllable spring action is afforded by forcing the entire length of the legs 38 apart which in turn simultaneously tends to force the leg ends 40 slightly forwardly along the inner surface of the walls 44 and 46 and tends to flatten the disposition angle between the ends 40 and the legs 38. Thus, rather than merely applying a force at the receiving nip between the legs 38, a spring-like action is imparted to the entire length of the element 18 disposed within the legs 38. Such action is shown diagrammatically in the drawing as by the transition between FIGS. 7 and 8 thereof.

Figure 5:
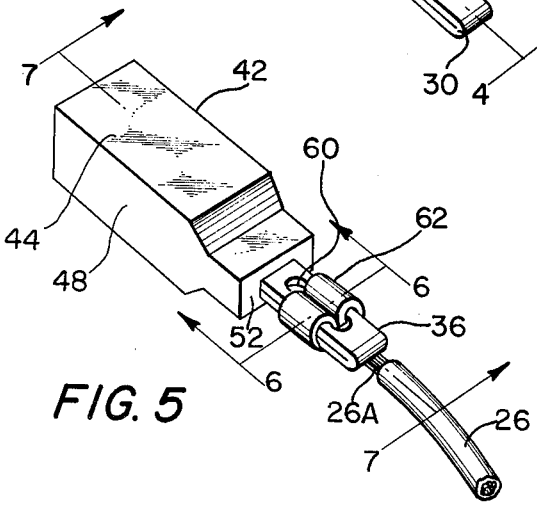
FIG. 5 is a perspective view similar to FIG. 3 but showing the manner in which a conductor wire may be mechanically and electrically fastened to the conductor tongue.
Figure 6:
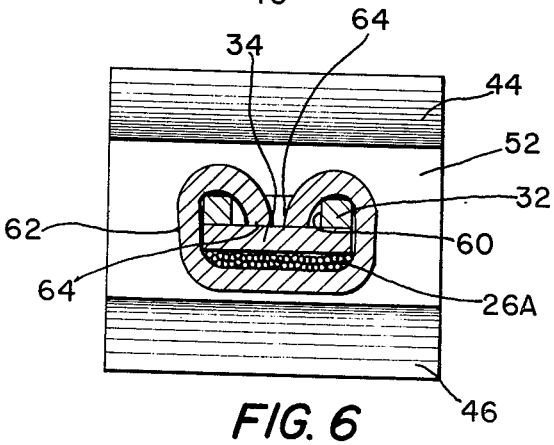
FIG. 6 is a sectional view on an enlarged scale taken along line 6—6 of FIG. 5.

The manner in which the conductors 26 are mechanically and electrically affixed to the tongues 36 of the respective contact element assemblies 22 will now be clarified. In that regard, the upper leg portion 32 in part forming the tongue 36 is provided with an opening or slot 60. The wires **26*a* of an individual conductor are exposed by stripping back the covering insulation and then disposed in contact with the outer surface of the lower leg portion 34. A metal band or clamp 62 having terminal ends 64 is then bent or otherwise formed about the tongue 36 in such a manner so as to position the conductor wires 26*a* between the lower face of the leg portion 34 and the inner surface of the clamp. The ends 64 of the clamp are then forced into the slot 60 so as to contact the upper face of the lower leg portion 34. In this position, the clamp is clenched by known tools so as to permanently deform such in the position as shown in FIGS. 5 and 6 such that suitable electrical and mechanical contact is provided between the conductors 26 and the contact element 28**. The resulting construction thus is particularly suited for the attachment of conductor wires to low profile tongues as utilized herein.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A connector of the type having a molded plug in which at least one contact element is housed within a separate enclosure having spaced upper and lower walls in part defining an open forward end, said contact element having a split terminal portion including a pair of spaced apart legs adapted to receive a male contact element projecting through said enclosure open end, said legs each having a major longitudinally extending body portion terminating in an outwardly angularly flared end disposed in respective contact with said upper and lower walls proximal said open forward end, said contact element leg body portions being generally spaced from said upper and lower walls except at said ends thereof whereby relative inward motion of said male element with respect to said legs tends to force said leg ends slightly forwardly along said walls towards said open enclosure end while simultaneously tending to flatten the disposition angle between said leg ends and said leg body portions, said enclosure including a rear wall having an opening therethrough, rearwardly disposed portions of said leg body portions adapted to pass through said opening and disposed in mutual face-to-face contact with each other both within said opening and at those portions thereof extending into said plug rearwardly of said enclosure rear wall opening, said legs being of essentially flat blade-like configuration, said enclosure rear wall opening being of flat slot-like configuration such that said legs passing in face-to-face disposition therethrough essentially block said rear wall opening such that material forming said plug cannot pass through said rear wall opening during the molding of said plug about said enclosure and said contact element, said leg body rear portions extending rearwardly of said enclosure rear wall opening forming a contact tongue to which an electrical conductor is attached, one of the said body portions of said tongue having an open slot disposed therethrough, said electrical conductor contacting the other of said tongue body portions of that face distal from said slot, and a clamp extending about said tongue and said conductor, said clamp having opposite ends disposed in said slot and in contact with the face of said other of said tongue body portions proximal said slot.

2. The connector construction of claim 1, said contact element formed of a single metal strip having a central U-shape bend at its rear terminus.

3. An electrical contact element assembly for use in an electrical connector plug comprising an integral generally flat metal strip having a U-shape bend centrally thereof to define a pair of legs in face to face contact with each other at a rear body portion thereof so as to form a contact tongue, one of said leg portions forming said tongue having an open slot disposed therethrough, an electrical conductor attached to said tongue and in contact with that face of the other leg portion distal from said slot, and a clamp extending about said conductor and said tongue, said clamp having opposite ends disposed in said slot.

4. The assembly of claim 3, said legs in spaced apart opposed position at forward portions thereof so as to receive a bayonet-type male contact element therebetween.

5. The assembly of claim 3, said clamp having said opposite ends thereof bent about said one leg portion and in contact with the face of said other leg portion which is disposed adjacent said slot.

* * * * *